United States Patent [19]

Kimbara et al.

[11] Patent Number: 4,553,569

[45] Date of Patent: Nov. 19, 1985

[54] CONTROL METHOD OF STOPPING A LOOM AT A PREDETERMINED POSITION THEREOF

[75] Inventors: Masahiko Kimbara; Akio Arakawa, both of Kariya, Japan

[73] Assignee: Kabushiki Kaisha Toyoda Jidoshokki Seisakusho, Kariya, Japan

[21] Appl. No.: 596,545

[22] Filed: Apr. 4, 1984

[30] Foreign Application Priority Data

Apr. 13, 1983 [JP] Japan ..... 58-63737

[51] Int. Cl.[4] ..... D03D 51/00

[52] U.S. Cl. ..... 139/1 E; 139/336; 364/470; 192/12 D

[58] Field of Search ..... 139/1 R, 1 E, 336, 340; 192/12 D, 139, 142 R; 364/167, 168, 169, 170, 470

[56] References Cited

U.S. PATENT DOCUMENTS 3,805,849 4/1974 Steverlynck ..... 139/1 E
3,805,850 4/1974 Duynhoven et al. ..... 139/1 E
4,364,002 12/1982 Suzuki et al. ..... 364/470 X
4,488,580 12/1984 Sainen et al. ..... 139/336
4,494,203 1/1985 Suzuki et al. ..... 364/470

*Primary Examiner*—Henry S. Jaudon
*Attorney, Agent, or Firm*—Brooks, Haidt, Haffner & Delahunty

[57] ABSTRACT

A method of stopping a loom, whose operation is controlled by a microcomputer, at a predetermined position thereof is disclosed herein. In view of the phenomenon that the load on loom operation is varied with the operating cycles thereof depending on the texture of fabric to be woven, but the variation takes place in repeated cycles of similar patterns each including different phases in succession of a known number, the method according to the invention comprises the steps of detecting the deviation of the actual stop position from the predetermined position resulting from the preceding loom braking operation, executing arithmetic operation on data regarding said deviation for compensation thereby to adjust the position at which brake is to be applied in the current braking operation, and applying brake when said position determined through said arithmetic operation is reached by the loom, wherein such steps are carried out in each group of the phases that correspond to each other in similarity.

7 Claims, 10 Drawing Figures

CONTROL METHOD OF STOPPING A LOOM AT A PREDETERMINED POSITION THEREOF

FIELD OF THE INVENTION

The present invention relates generally to a control method of stopping a loom at a predetermined position thereof. More specifically, it relates to a control method of stopping a loom, whose operation is placed under the control of a microcomputer, at a predetermined position thereof regardless of the kind of texture varying with fabrics to be woven.

BACKGROUND OF THE INVENTION

With the recent increasing scope of microcomputer applications in various fields, there have appeared such weaving machines or looms that are equipped with a microcomputer which is used to control their operation. It is known to those skilled in the art that such microcomputer-controlled looms have advantages in that: (1) Production of inferior fabrics due to erroneous machine operation or malfunctioning of stop motion can be forestalled; (2) Loom maintenance can be facilitated greatly thanks to improvement in detection of abnormalities and in locating cause of any trouble associated with loom's control system; and (3) Microcomputer programming can make possible versatile capabilities of the loom and ease of the programming improves the control flexibility.

The use of a microcomputer in a loom can realize special control features that had been practically impossible with conventionally-controlled looms. The present invention refers to one such control feature in a loom, i.e., a control method by which loom's time-controlled operating system is brought to a stop at a predetermined position thereof when its motor is turned off with application of a brake because of a break in weft or warp yarn or occurrence of any abnormal situation in the loom. The predetermined position denotes a predetermined crank angle of crankshaft of the loom which is driven to rotate by the motor and the rotation of which governs the operating cycle of the time-controlled system of the loom.

It cannot be ensured, however, that the loom is brought to a stop at said predetermined crank angle by turning off the motor with simultaneous application of the brake which is operatively connected to the motor. It is because a constant braking force cannot be maintained at all times for a long period of service of the brake due to various influencing factors such as progressively increasing wear in the brake. If the loom fails to be stopped at the predetermined position after turning off the motor and application of the brake in response to a signal due to a break in either weft or warp yarn, the loom will be placed where it is inconvenient for the yarn breakage to be remedied. With an air-jet loom, it may be brought to a stop where air as the medium for weft picking is kept in an undesirable discharged state in spite that the loom is at a halt. In the event of such failure in stopping the loom at said predetermined position, manual adjustment should be performed by an operator so as to move the loom to the predetermined stop position.

However, the use of a microcomputer has made it possible to provide a control feature by which the loom can be stopped at a predetermined crank angle, thus dispensing with the above troublesome and time-consuming manual adjustment. U.S. patent application Ser. No. 367,959, the details of which will be described in later part hereof, discloses a control method for such a purpose. This method, which is carried out in a loom wherein the position where brake is applied for stopping of the loom is so adjusted that it may be stopped correctly at a predetermined crank angle, comprises the steps of detecting and storing the deviation of the actual stop position from said predetermined crank angle caused during just the previous braking operation, executing arithmetic processing operation for compensation for the current braking position on the basis of data regarding said deviation of the actual stop position during the previous braking operation, applying brake when the position determined through said compensation is reached by the loom, and detecting and storing the deviation of the actual stop position from said predetermined crank angle during the current braking operation for providing data for similar compensation for the braking position in braking operation that follows.

According to this prior art method, compensation is thus provided automatically in such a way that the loom may be stopped at the predetermined position, thereby the machine operator being released from troubles associated with monitoring the loom for its stop position and laborious, time-consuming manual adjustment. On the other hand, however, provision of the above automatic compensation rather poses a serious problem in that, depending upon fabrics to be formed, the purpose itself of the control method may not be accomplished. The problem is derived from the fact that the load imposed on the loom during each operating cycle or rotation thereof varies depending upon the kind of fabric texture to be formed. Though the lenght of time required for one pick in forming a plain-woven fabric is kept substantially constant, the time in weaving, for example, a corduroy varies in a specific way. It is because the load or the resistance in forming a shed in weaving operation changes from time to time according to the kind of texture of fabric to be produced. In view of such a phenomenon in weaving operation, the above-mentioned prior art method, according to which the position of current brake application is determined from the data of deviation of the actual stop position from the predetermined crank angle during the previous brake application, offer a problematic disadvantage. That is, if brake is applied currently at a position which corresponds to the maximum shedding load on the basis of stored data obtained at a position where the shedding load was the minimum, or vice versa, the stored data will not perform its intended function of compensating correctly for the position of current brake application, but adversely affect the control by amplifying an error in compensation. Thus, the proposed control method which is designed to realize accurate stopping of a loom at a predetermined position thereof eventually poses a problem in that the accuracy can be no more ensured if there takes place variation in shedding load which is determined by the type of fabric texture.

SUMMARY OF THE INVENTION

It is an object of the present invention, therefore, to solve the above-mentioned problem by providing a control method by use of which a loom can be stopped at a predetermined position with a high standard of accuracy, regardless of difference in texture of fabrics to be woven on the loom.

In order to achieve the abovesaid object of the invention, the present inventors, who noted the fact that the length of time during which the crankshaft of a loom makes a complete operating cycle of rotation shows a given and repeatable pattern of cycle according to each specific kind of fabric texture, have created a method of stop controlling in a loom which is equipped with an additional device for presetting, when said variation pattern of cycle includes different phases as many as N (N is an integral number more than "1"), the number N. The method according to the invention comprises the steps of detecting and storing the deviation of the actual stop position from a predetermined position during just the previous braking operation and of executing arithmetic processing operation for compensation for the position of current brake application on on the basis of data regarding said deviation, wherein said steps are performed with reference to any specific phase of said preset N phases.

The above and other objects, features and advantages of the present invention will become more readily apparent from the following detailed description of preferred embodiment thereof, taken in conjunction with the accompanying drawings, wherein:

DETAILED DESCRIPTION OF THE PREFERRED EMBODIMENT

Figure 1:
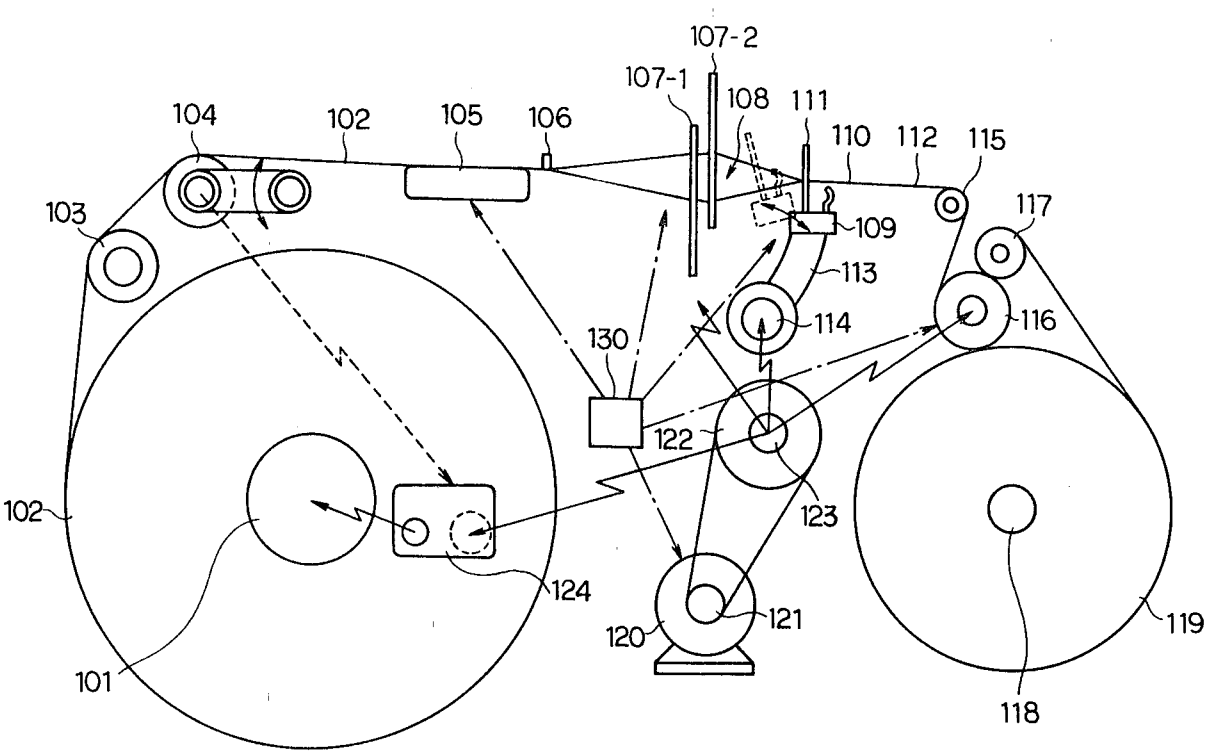
FIG. 1 is a schematic view showing a loom of typical structure to which the present invention is applied.

Referring to FIG. 1 illustrating schematically a loom of typical construction in which an embodiment of method according to the invention may be carried out, reference numeral 101 designates a yarn beam which has a great number of warp yarns 102 wound thereround in parallel relation to each other and allows them to be unwound therefrom and then moved via a back roller 103 and a tension roller 104 toward a warp stop motion unit 105 which includes a dropper (not shown) for each of said warp yarns 102. If a break occurs in any of the warp yarns 102, its corresponding dropper detects the break and the loom is caused thereby to stop its weaving operation for permitting repair of the warp yarn break. The warp yarns 102 which have passed through the warp stop motion unit 105 are then alternately divided up and down into two groups by heald frames 107-1 and 107-2, while being pressed by means of a presser bar 106, thereby forming an opening therebetween, or a shed 108 through which a weft yarn inserted by any weft picking medium such as an air jet discharged from an air jet nozzle (not shown) is transferred while being guided by a plurality of weft guide members 110 mounted on a sley 109. The sley 109 has a reed 111 fixedly mounted thereon for beating up each of the inserted weft yarns rightwards (as seen in FIG. 1) against a woven fabric 112 through the swinging motion of the sley 109, which is imparted by a rocking shaft 114 via a sley sword 113. In this way, the fabric 112 is woven.

The woven fabric 112 passes via a breast beam 115, a surface roller 116 and a press roller 117 to be wound up round a winding roller 118. Reference numeral 119 designates the woven fabric thus wound up round the winding roller 118.

Power necessary for the above operations is supplied by a motor 120. That is, rotation of the motor 120 is transmitted to a crankshaft 123 via a motor pulley 121 and a driving pulley 122 and, simultaneously, the rotation of the crankshaft 123 is in turn transmitted further to individual mechanisms as indicated by jagged arrows (FIG. 1). The yarn beam 101 is supplied with power by way of a transmission 124, to which a feedback signal is transmitted from the tension roller 104 as indicated by a dotted, jagged arrow for controlling the transmission operation in such a way that the yarn beam 101 may be rotated to pay off the warp yarns 102 at a proper tension.

The control method according to the invention is performed preferably in a loom whose operation is placed under the direct control of a microcomputer. Such a microcomputer is schematically shown by a block having reference numeral 130, and it is connected operatively, as indicated by dash-and-dot arrows, to individual mechanisms of the loom that call for controlling by the microcomputer 130. (In actual practice, the dash-and-dot arrows represent signal lines to be connected between individual I/O (Input/Output) ports of the microcomputer 130 and the operating mechanisms of the loom).

Figure 2:
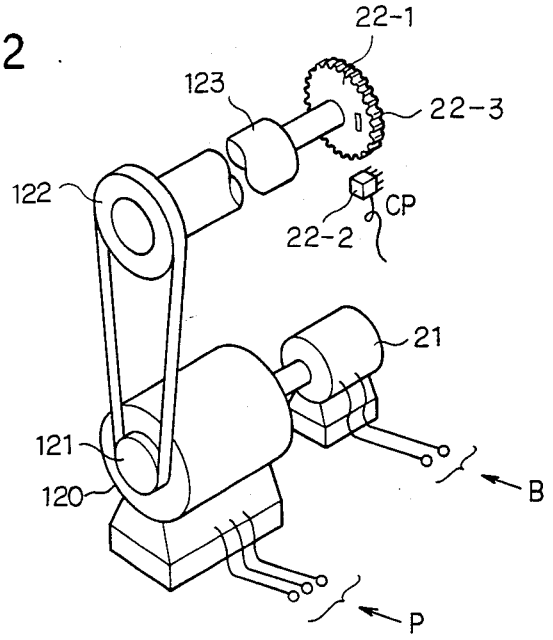
FIG. 2 is a perspective partial view showing a main motor which operatively connected on one hand with a brake and on the other with a crankshaft of the loom shown in FIG. 1, said crankshaft being shown with a crank angle detector.

Referring then to FIG. 2 showing part of the loom of FIG. 1 in perspective view, reference numeral 21 designates a brake which is connected to and, when energized, brakes the shaft of the motor 120. Though the brake 21 is thus connected directly to the motor shaft, it may be connected to any other parts of the loom such as the crankshaft 123. When stopping the motor 120, power P thereto is shut off and, simultaneously, power B is applied across the brake 21. By so doing, the crankshaft 123 rotated by the motor 120 through the pulleys 121, 122 to brought to an immediate stop. Usually, the crankshaft 123 is brought to a complete stop before it makes a full turn from the moment when brake is applied. The crankshaft 123 should preferably be braked to a stop at a predetermined position, or at a given crank angle thereof. For this reason, the crankshaft 123 is equipped with a crank angle detector 22 (FIG. 3) for continually monitoring the current crank angle of the crankshaft. As shown in FIG. 2, the crank angle detector 22 includes a disc 22-1 having a number of teeth formed at its periphery at a constant interval and a sensor 22-2 fixed adjacently to said disc 22-1. In operation, the sensor 22-2 generates crank angle pulses CP in synchronism with the movement of the disc 22-1 rotating together with the crankshaft 123. That is, the sensor 22-2 produces one crank angle pulse CP each time a tooth on the disc 22-1 moves past adjacently to the sensor 22-2, for example, by electromagnetic coupling effect. Thus, successive crank angle pulses CP are produced by the sensor 22-2 in a pulse train. In this arrangement for detecting crank angles, a permanent magnet 22-3 is attached at a predetermined position in the disc 22-1 for defining the absolute crank angle which corresponds to the home or reference position of the disc 22-1, therefore of the crankshaft 123.

Instead of using a crank angle detector which is adapted to count the number of generated pulses as exemplified in FIG. 2, a detector of the type which uses an absolute encoder directly indicating the crank angle on the disc by forming a binary code or other coded pattern may be employed.

When a signal calling for a stop of the loom operation is generated, brake is applied at such a crank angle that the crankshaft 123 may be braked to a stop at a predetermined position thereof.

Figure 3:
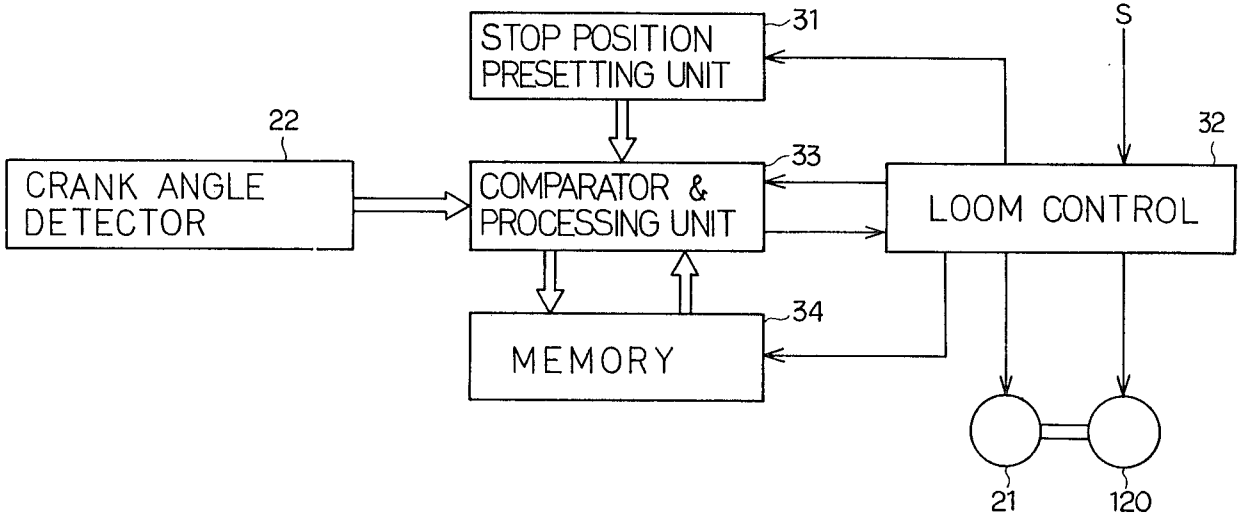
FIG. 3 is a block diagram showing the control system for carrying out the method disclosed by the aforementioned U.S. patent application Ser. No. 367,959.

FIG. 3 is a block diagram showing the control system for carrying out the method disclosed by the U.S. patent application Ser. No. 367,959, now U.S. Pat. No. 4,494,203, wherein reference numerals 120, 21 and 22 designate the motor, brake and crank angle detector, respectively, that are discussed earlier herein in connection with FIGS. 1 and 2. Operation of the motor 120 and the brake 21 is controlled by a loom control 32. When the loom control 32 receives a stop signal S, it is operated in such a way that the crankshaft 123 may be braked to a stop at a crank angle thereof which is previously set by a stop position presetting unit 31. In FIG. 3, reference numerals 33 and 34 designates a comparator & processing unit and a memory, respectively. Though the elements in the control system are illustrated as discrete modules, they are actually contained in the aforementioned microcomputer 130 and controlled by its program.

The prior art method according to the U.S. patent application Ser. No. 367,959 will be now explained more in detail in the following with reference to FIGS. 4, 5A and 5B, for the sake of ease of understanding the present invention.

Figure 4:
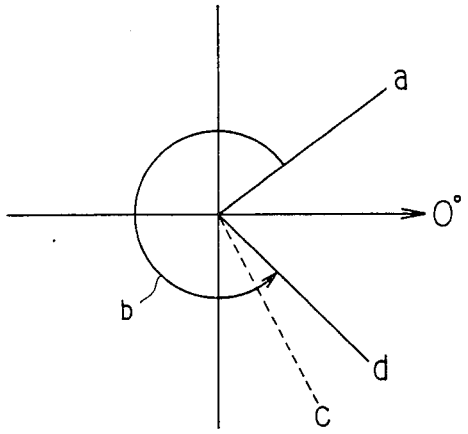
FIG. 4 is a diagram illustrating various crank angles of the loom shown in FIG. 1.

Referring to FIG. 4 graphically showing various points in crank angle of the crankshaft 123, a indicates the crank angle at which brake is to be applied and c represents a predetermined crank angle at which the crankshaft 123 is to be stopped, said predetermined crank angle being preset by the stop position presetting unit (FIG. 3) through digital setting. As seen from FIG. 4, the crank angle c is illustrated as about 300°. As discussed earlier herein, however, since the braking force cannot be maintained constant at all times for a long period of service, the crankshaft 123 tends to stop at a position other than c, for example, at a crank angle d, wherein the crank angle d varies from time to time for the same reason as stated in the above. Thus, d denotes an actual stop position of the crankshaft 123. Reference symbol b indicates, therefore, a crank angle through which the crankshaft 123 has rotated before it is stopped at d after brake is applied thereto at a.

Figure 5A:
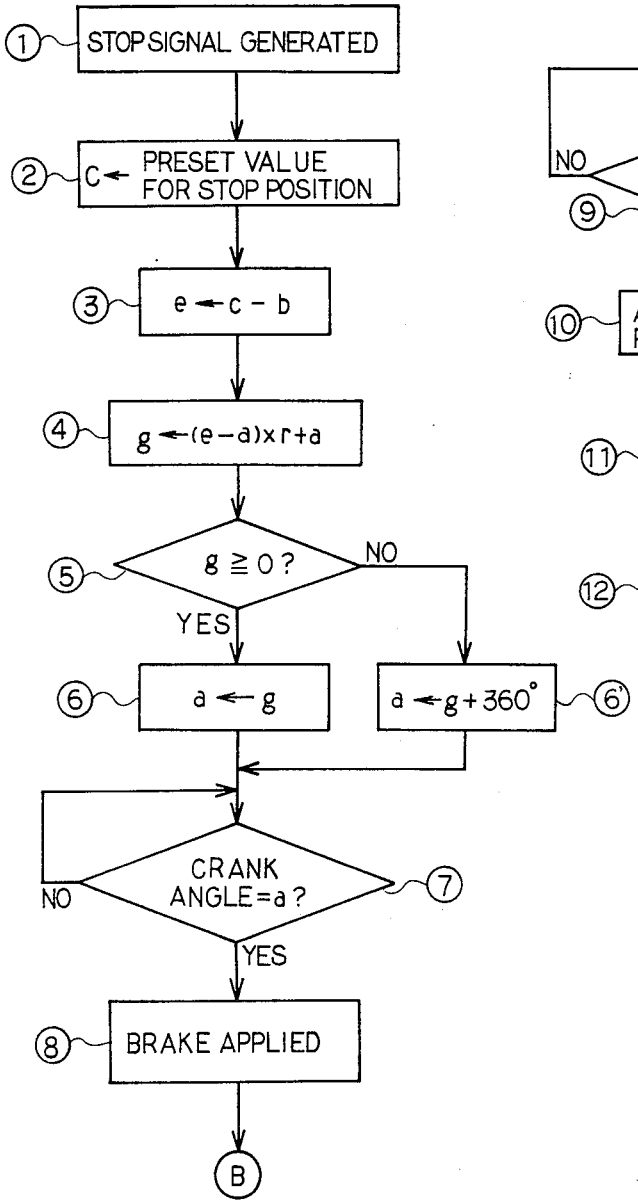
FIGS. 5A and 5B are flow charts showing various steps of the method according to the U.S. patent application Ser. No. 367,959.

Referring then to FIG. 5A providing a flow chart illustrating various steps performed sequentially by the prior art method, a stop signal s (FIG. 3) is generated in step ①. In the following step ②, the digital preset value c (FIG. 4) is entered as an input data into the comparator & processing unit 33, as indicated by a double-line arrow between the stop position presetting unit 31 and the comparator & processing unit 33 in FIG. 3. The time at which such input of data c is effected is determined by the loom control 32. For your reference, referring back to FIG. 3, double-line arrows show directions of data flow and single-line arrows designate directions of control signal flow. In step ③ that follows, the comparator & processing unit 33 executes an arithmetic operation of $2 \leftarrow c - b$. It is important to note here that the value for b in the above arithmetic operation represents data obtained from the crank angle d at which the crankshaft 123 had actually stopped during the stopping operation that just precedes the current loom stopping operation. That is, it is the data which represents the quantity of deviation of the actual stop position d from the predetermined crank angle c resulting from the preceding loom stopping operation and is stored in the memory 34 (FIG. 3) for adjustment in the current loom stopping operation. In other words, therefore, data for the deviation resulting from the current stopping operation will be utilized for the adjustment in the loom stopping operation that follows. It is desirable that such b should be thus utilized even after an interruption of loom operation due to power outage or for any other reasons. Therefore, the memory 34 should be of a non-volatile type.

As it is now understood from the foregoing, the value e obtained in the above arithmetic operation in the step ③ means that the crankshaft 123 would have been stopped at said predetermined crank angle c in the preceding stop if the current value for e should be equal to that for a.

In step ④, an arithmetic operation as expressed by $g \leftarrow (e-a) \times \gamma + a$ is executed by the comparator & processing unit 33, wherein $\gamma$ represents compensation factor and in the illustrated embodiment "½" is selected for $\gamma$. It should be noted that if the compensation factor $\gamma$ is set at "1" so as to provide 100% compensation, there is a fear that the result from the compensation tends to be fluctuated due to various influencing factors such as external disturbances and/or errors, thus making it difficult to accomplish convergence toward the target crank angle c. Therefore, a value smaller than "1" is usually selected for the compensation factor $\gamma$. The data g obtained in the preceding step ④ has positive (+) or negative (−) value. Whether the value for g is positive (YES) or negative (NO) is determined in the following step ⑤. If it is positive (YES), the data g is substituted for data a, or the crank angle a at which brake is to be applied in the current loom stopping operation, in step ⑥; if negative (NO), it is substituted for the data a only after 360° is added thereto in step ⑥'. Such processing operations are performed by the comparator & processing unit 33.

In the subsequent step ⑦, the crank angle detector 22 (FIGS. 2 and 3) verifies that the crank angle a, which has been obtained directly from the data g in the step ⑥ or from g+360° in the step ⑥', is reached by the crankshaft 123, which is followed by the next step ⑧ in which brake is applied to the crankshaft by simultaneous de-energization of the motor 120 and energization of the brake 21 under the control of the loom control 32.

It is thus ensured that the crankshaft 123, therefore the time-controlled system of the loom, is braked to a stop substantially at the predetermined position. For the sake of locating the crank angle at which brake is to be applied in the next loom stopping operation, the crank angle b through which the crankshaft 123 is rotated after application of the brake and before it is to be stopped completely must be measured. For this reason, the last step in the flow chart of FIG. 5A is further followed by the steps provided by the flow chart in FIG. 5B.

Figure 5B:
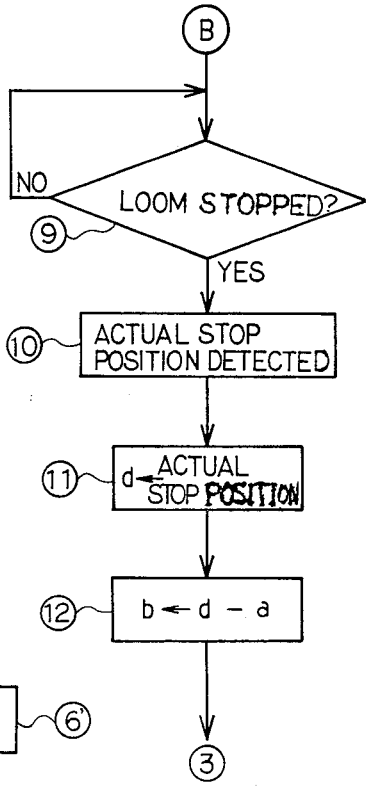

Referring to the flow chart of FIG. 5B which is linked at Ⓑ with that of FIG. 5A, it is verified in step ⑨ that the loom has been brought to a complete stop. When the loom has been stopped completely (YES), its actual stop position in crank angle is determined or detected by the crank angle detector 22 in step ⑩ that follows. Thus, the actual stop position, or crank angle d, in the current loom stopping operation is obtain, as in step ⑪. In the last step ⑫ in the flow chart of FIG. 5B, an arithmetic operation d−a is performed, wherein a is the data of crank angle at which the current brake application was provided, for obtaining the data b which is to be utilized for adjustment in the subsequent loom stopping operation. Though the same symbol b is used in the step ③ in FIG. 5A and the step ⑫ in FIG. 5B, it should be noted that, as discussed earlier herein, the data b in the step ③ is the data which had been obtained from just the previous loom stopping operation and have been utilized in the current operation; while the data b in the step ⑫ has been figured out in the current operation and is to be utilized for the loom stopping operation that follows.

An embodiment of method according to the present invention will be now described with reference to FIGS. 6, 7, 8A and 8B. As it will be seen from FIGS. 7, 8A and 8B, as well as from the detailed description thereof, the control system (FIG. 7) of a loom by which the method of the invention is carried out includes an additional element and the flow charts (FIGS. 8A and 8B) of said method have additional step, accordingly.

Figure 6:
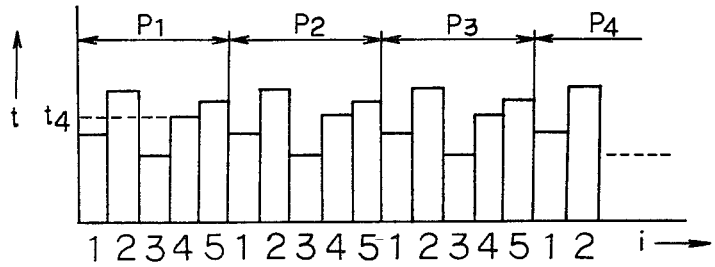
FIG. 6 is a graph showing an example of manner in which the load on the loom in each operating cycle thereof is varied according to a specific kind of fabric texture.

FIG. 6 provides a graph exemplifying the variation in load imposed on a loom in each operation cycle thereof. As stated earlier herein, the manner in which the load variation takes place is dependent upon the texture of fabric to be woven. The graph in FIG. 6 thus providing an example of variation of load in weaving operation on a loom tells that if the control method of stopping the loom at a predetermined position is carried out strictly according to the flow charts in FIGS. 5A and 5B, errors may result depending upon the fabrics to be produced.

In the graph, the axis of abscissa thereof represents different phases $i_1$, $i_2$, $i_3$, $i_4$ and $i_5$, each corresponding to each of the succeeding operating cycles of the loom, and the axis of ordinate shows the length of time t for each of said phases. To be more concrete, this time t refers to the length of time during which the crankshaft (FIG. 2) makes a complete turn through 360° of crank angle shown in FIG. 4 for each pick. The time t remains substantially constant with very little variation in forming plain-woven fabrics. However, in weaving, for example, a corduroy, the time t won't remain constant as is in forming the plain-woven fabrics, but varies in a specific way due to variation of load imposed in forming sheds in the respective picks. The load in forming sheds means the load which is imposed on alternate up and down movements of the heald frames 107-1 and 107-2. This means that the load acts also as a load imposed on braking when stopping the loom operation. Though the shedding load varies with the picks, the variation in loom operating cycle time t shows a repetition of similar patterns of variation, as indicated by P1, P2, P3, P4, etc. When the loom operation in each such pattern is divided into phases as many as N, as $i_1$, $i_2$, $i_3$ . . . $i_n$ (N equals to "5" in the illustrated embodiment), it can be seen that the shedding load in similar phases that correspond to each other is substantially the same, as the time $t_4$ for the phase $i_4$ in each of the patterns P1, P2, P3, etc. reads substantially the same.

If the process of the flow charts in FIGS. 5A and 5B is performed as it is in weaving any fabric which causes a remarkable variation in shedding load or in length of time t such as the one exemplified in FIG. 6, errors resulting from such variation are unavoidable. For example, if the data b (representing the deviation of the actual stop position from the predetermine position) which had been stored in the memory 34 during the phase $i_3$ (where the shedding load is the smallest) in the pattern p1 is used for adjustment in braking the loom to a stop during the phase $i_2$ (where the shedding load is the greatest) in the pattern p2, exact positioning of the loom cannot be accomplished as a matter of course. In other words, it is required that the method of the prior art shown in FIGS. 5A and 5B should be performed during any given phases having substantially the same shedding load for achieving the desired accuracy in braking the loom to a stop at a predetermined crank angle.

Figure 7:
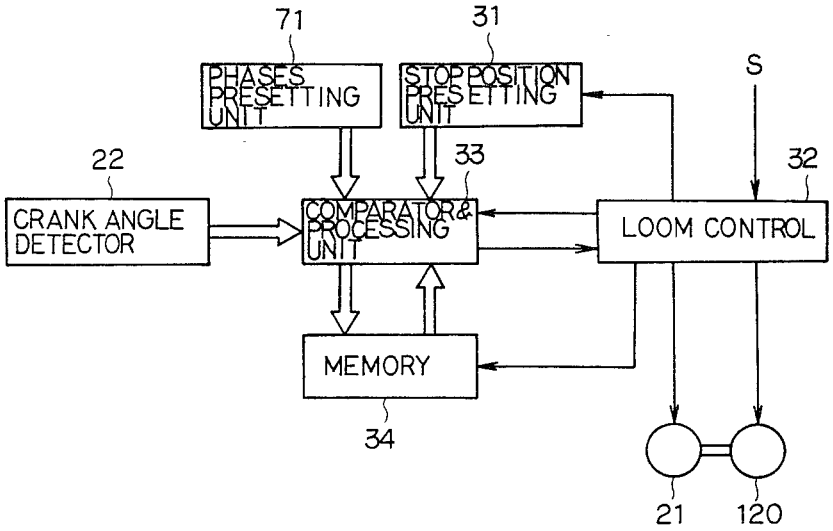
FIG. 7 is a block diagram similar to that provided in FIG. 3, but showing the control system for carrying out the method according to the present invention.

In a preferred embodiment of the invention, the control system for carrying out the embodiment of method includes a unit for presetting the number N of the abovesaid phases. The value for N, though varying with the fabric texture, is known for each type of the fabric texture. FIG. 7 shows the control system which includes the additional phases presetting unit 71, as well as elements similar to those which are shown in FIG. 3. A value for the number N of phases (or "5" in illustrated embodiment) is initially set in this presetting unit 71 and the data of N is stored in the memory 34 through the comparator & processing unit 33. Accordingly, the flow charts in FIGS. 8A and 8B showing the preferred embodiment of the invention includes new steps in addition to those steps which are used in the prior art method.

Figure 8A:
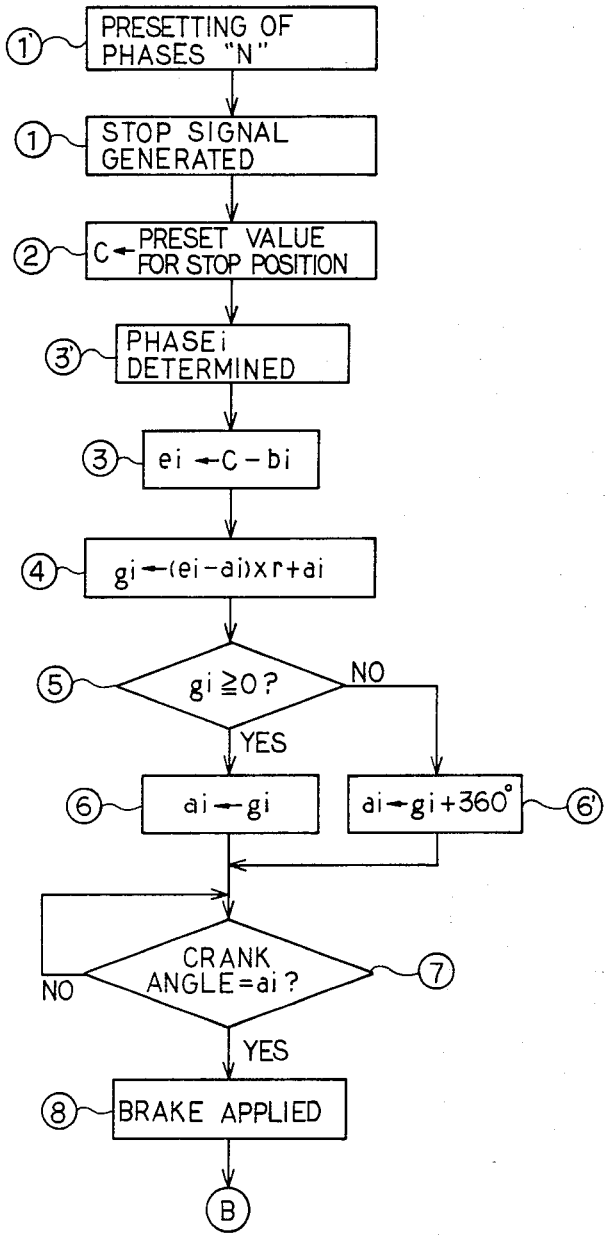
FIGS. 8A and 8B are flow charts similar to those provided in FIGS. 5A and 5B, respectively, but showing various steps in an embodiment according to the present invention.

Referring firstly to FIG. 8A, the data of N is preset by use of the presetting unit 71 and stored in the memory 34 through the comparator and processing unit 33 in step ①' prior to the step ① discussed in connection with the flow chart of FIG. 5A. Thus, the microcomputer 130 recognizes that each of the relevant steps that follow should be executed on the basis of various data obtained during each specific or corresponding phase i. That is, the data including a, b, d, e and g in the steps ③, ④, ⑤, ⑥, ⑥', ⑪ and ⑫ are processed in respect of each of the phases i, as suggested by $a_i$, $b_i$, $d_i$, $e_i$ and $g_i$ in FIGS. 8A and 8B. For making possible such processing of relevant data corresponding to each specific phase i independently of the other phases, the memory 34 (which correponds to a RAM, or a Random Access Memory, in the microcomputer 130) is divided into as many memory regions as the number N of the phases i.

Since the data a to g are processed in respect of each of the phases i, as $a_i$ to $g_i$, it is necessary for the microcomputer 130 to verify at which phase the stop signal S has been generated. For this reason, steps ③' and ⑪' are inserted just before the steps ③ and ⑪, respectivly, for determining the phase i. Since the current phase i is monitored constantly by the microcomputer 130, the determination of the phase i in the steps ③' and ⑪' can be accomplished with ease. With the addition of the step ③', therefore, the last step ⑫ in FIG. 8B is followed by the step ③' in FIG. 8A, not the step ③.

Figure 8B:
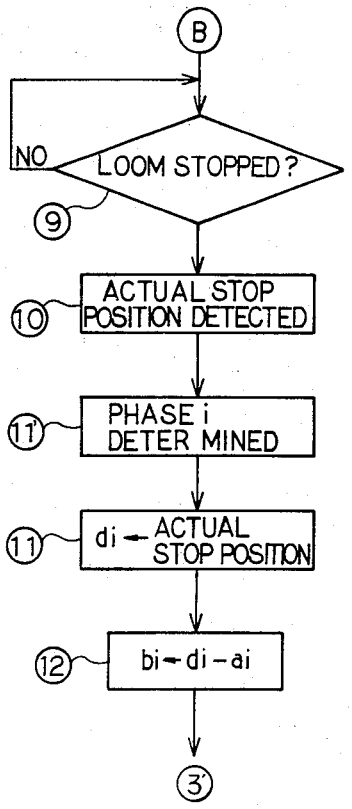

In order to permit the flow charts in FIGS. 8A and 8B to perform their intended function, it is desirable that the data $b_i$ for each of the phases ($i_1, i_2 \ldots i_N$) should be previously found. Therefore, it is necessary to previously perform all the steps in the flow charts by generating the stop signal S at each of the phases in a pattern of variation.

As it is now apparent from the foregoing, the method of stopping a loom at a predetermined position according to the present invention is capable of solving the problem of the prior art method in that introduction of automatic compensation thereby has had an adverse effect to amplify the errors in controlling depending upon the type of fabric textures, and thus realizing high standard of control in braking the loom to a stop at the predetermined position.

While the invention has been illustrated and described with reference to a specific embodiment thereof, it is to be understood that various modifications in the details of the method may be made without departing from the spirit and scope of the invention.

What is claimed is:

1. A method of stopping a loom at a predetermined position thereof in a weaving operation wherein the braking load is varied with operating cycles of the loom in repeated patterns each of which includes a group of succeeding different phases which are of a number N, greater than one, said pattern and said number N being determined according to the kind of texture of fabric to be woven, said method comprising:

first step of separately detecting, for each phase in which the loom is stopped, the quantity of deviation, if any, of the actual stop position of the loom from said predetermined position resulting from loom braking operation in the same phase that precedes the current braking operation and storing data regarding said deviation;

second step of executing arithmetic operation on said data for compensation thereby to adjust the position at which brake is to be applied in the current loom braking operation for said phase in which the loom is stopped;

third step of applying braking when said position determined through said arithmetic operation is reached by the loom; and fourth step of detecting for said phase in which the loom is stopped the quantity of deviation, if any, of the actual stop position of the loom from said predetermined position resulting from the current braking operation in said phase in which the loom is stopped;

said steps being performed for each group of corresponding phases in which the variation in said braking load in each group is substantially the same.

2. A method according to claim 1 wherein said loom is driven through a crankshaft and said position of said loom corresponds to the crank angle of said crankshaft.

3. A method according to claim 2, wherein, in said first step, an arithmetic operation of $e \leftarrow c-b$ is executed, wherein c represents a crank angle corresponding to said predetermined position, b a crank angle through which the crankshaft had rotated after brake application and before it is brought to a complete stop, e is data resulting from $c-b$, said arithmetic operation providing the data regarding said deviation.

4. A method according to claim 3, wherein, in said second step, a series of arithmetic operations are executed, namely: $g \leftarrow (e-a)\gamma+a$, wherein a represents a crank angle at which brake is to be applied, $\gamma$ a compensation factor, and g is data resulting from $(e-a)\gamma+a$; determining whether the resultant data g is positive (including zero) or negative; and substituting the data g for a, as $a \leftarrow g$ if g is positive (including zero) or $a \leftarrow g+360°$ if g is negative, thus effecting compensation thereby to adjust the crank angle a at which brake is to be applied.

5. A method according to claim 4, wherein said compensation factor $\gamma$ is established smaller than "1".

6. A method according to claim 5, wherein, in said third step, braking is applied when the crank angle a is reached by the crankshaft.

7. A method according to claim 6, wherein, in said fourth step, a crank angle d at which the crankshaft has actually stopped is detected and then an arithmetic operation $b \leftarrow d-a$ is executed.

* * * * *

UNITED STATES PATENT AND TRADEMARK OFFICE

CERTIFICATE OF CORRECTION

PATENT NO. : 4,553,569

DATED : November 19, 1985

INVENTOR(S) : KIMBARA ET AL.

It is certified that error appears in the above-identified patent and that said Letters Patent is hereby corrected as shown below:

Column 2, line 34, "lenght" should be --length--.

Column 3, line 16, "on on" should be --on--.

Column 4, line 57, "to brought" should be --is brought--.

Column 5, line 67, "s" should be --S--.

Column 6, line 11, "2" should be --e--.

Column 6, line 25, "such b" should be --such data b--.

Column 8, line 3,"$i_n$" should be --$i_N$--.

Column 8, line 17, "pl" should be --P1--.

Column 8, line 35, "in illustrated" should be --in the illustrated--.

Column 8, line 19, "p2" should be --P2--.

Signed and Sealed this

*Twenty-fifth* Day of *March 1986*

[SEAL]

*Attest:*

DONALD J. QUIGG

*Attesting Officer*

*Commissioner of Patents and Trademarks*